United States Patent [19]

Frommert

[11] 4,368,760

[45] Jan. 18, 1983

[54] PILE FABRIC AND METHOD FOR MANUFACTURE THEREOF

[75] Inventor: Siegwart K. Frommert, Korschenbroich, France

[73] Assignee: Societe Alsacienne de Constructions Mecaniques de Mulhouse, Mulhouse, France

[21] Appl. No.: 174,897

[22] Filed: Aug. 4, 1980

[30] Foreign Application Priority Data

Aug. 20, 1979 [FR] France ..... 79 20931

[51] Int. Cl.[3] ..... D03D 27/10; D03D 27/06; D03D 19/00

[52] U.S. Cl. ..... 139/397; 139/402; 139/419

[58] Field of Search ..... 139/397, 398, 391, 402, 139/403, 419, 21

[56] References Cited

U.S. PATENT DOCUMENTS 2,252,433 8/1941 Koch ..... 139/397

FOREIGN PATENT DOCUMENTS 103341 6/1899 Fed. Rep. of Germany ..... 139/397
1434564 2/1966 France ..... 139/391

*Primary Examiner*—James Kee Chi
*Attorney, Agent, or Firm*—Holman & Stern

[57] ABSTRACT

The invention is related to the textile industry and the weaving of pile wherein, the parts of the pile yarn loops adjacent the tops of these loops are pinched against one side of the warp yarn of the ground weave by an extra yarn, or leno yarn, similar to the leno yarn employed in the weaving of gauze.

10 Claims, 16 Drawing Figures

FIG.1
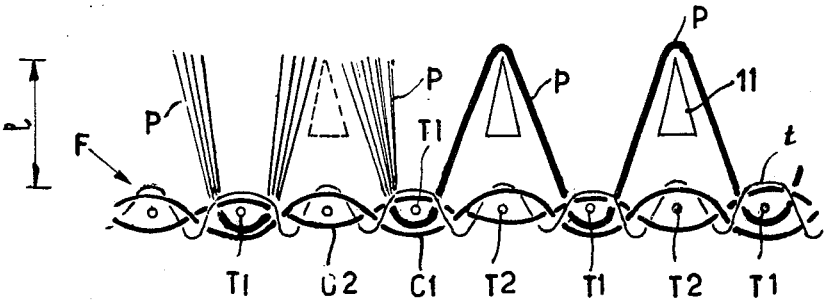
FIG.2
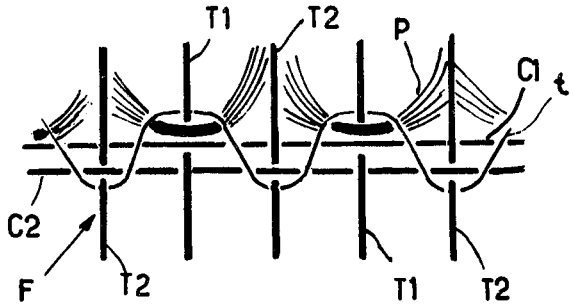
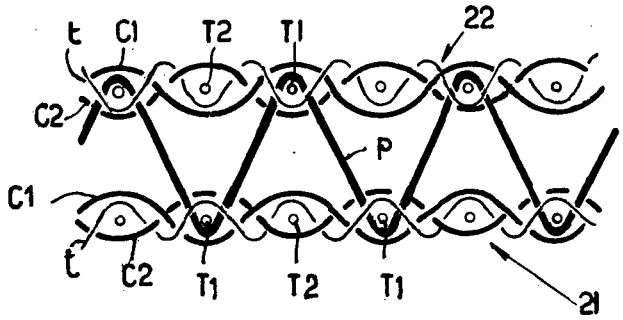
FIG.3
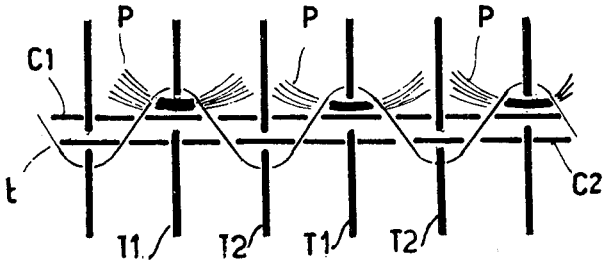
FIG.4

PILE FABRIC AND METHOD FOR MANUFACTURE THEREOF

FIELD OF THE INVENTION

The present invention relates to warp pile fabrics comprising a ground weave of warp yarns crossed with weft yarns on which, on the reverse side of the weave, are situated the tops of the loops of pile yarns, whose branches pass through the thickness of the ground weave, between the warp and weft yarns, and extend, at the front of the ground weave, over a certain length to produce the pile effect of velvet.

Such a structure is well-known but has certain disadvantages. For example, with the majority of known methods of manufacture of pile fabrics, the securing of the pile in the ground weave is determined by various factors, such as: weft count, warp count, determination of blend and nature of yarns, type and length of fibres, finishing of the fabric (especially impregnation of the reverse side) and patterns of weave. The decision of choice in weaves is therefore limited by numerous imperatives and piles are in general only very dense and relatively heavy.

DESCRIPTION OF THE PRIOR ART

A method of manufacture of pile is already known from U.S. Pat. No. 2,252,433, in which it is attempted to secure the pile yarn loops in the ground weave by means of leno warp yarns. However, in this process, normal warp yarns are employed as leno yarns and these, in fact, form the ground weave, so that these leno yarns simply cover over, or sit astride the tops of the pile yarn loops on the reverse side of the fabric. It is therefore a disadvantage of this method that it does not secure the loops of pile yarn, in relation to the ground weave, with a suitable degree of strength. In order that the pile yarns may be held most firmly in the ground weave, (this, indeed, only within the limitations set by this process), it would be necessary to produce the densest possible weave, which would, of course, depart from the object of the method, i.e. to offer a velvet which is light and well-aerated.

The object of the invention is to produce a warp pile fabric which does not suffer from these disadvantages and limitations of known pile fabrics as described above.

SUMMARY OF THE INVENTION

According to the invention, the parts of each pile yarn loop adjacent the tops of said loops are firmly pinched against a warp yarn of the ground weave by an extra gauze-weave warp yarn, referred to an "leno yarn", which forms a *first* loop, the top of which lies on the same weft yarn of the ground weave as the top of the pile yarn loop, but on the front side of the ground weave, and a *second* loop, the top of which lies on an adjacent weft yarn, also on the front side of the ground weave, the two aforesaid loops of leno yarn being interconnected by an intermediate part of this yarn which passes under the warp yarn concerned, on the reverse side of the ground weave.

Due to this particular structure, each pile yarn loop is, in a way, knotted between three yarns, i.e. a weft yarn, a warp yarn and a leno yarn, so that it is most securely held in the ground weave and is thus much more resistant to rupture than pile yarn loops of known pile fabrics which are simply squeezed between the warp and weft yarns of the ground weave, or else the tops of which are simply covered over with one of the warp yarns of the ground weave to which a leno has been added, that is to say, without the knotting effect given by the leno yarn of the pile according to the invention. This special and novel feature renders impregnation of the reverse side of the fabric unnecessary and, in addition, makes it possible to produce pile fabrics which are as aerated as could be desired, that is to say, in which the width of the stitches in the ground weave is as large as one could wish, and in which the interval between two adjacent tufts of pile yarn can be chosen at will since each pile yarn loop is individually and very efficiently knotted by a leno yarn to a weft yarn and against a warp yarn.

In a fabric according to the invention, the leno yarn interlaces warp yarns and weft yarns in a manner similar to that of the leno yarns employed in the weaving of gauze and, in addition, it anchors the pile yarn. As will be seen hereinafter, on this principle, it is possible to produce a whole variety of pile fabrics according to the manner in which one combines the different elements each contains.

The invention further relates to a method of manufacture of this pile fabric, whereby a ground weave is formed from warp yarns crossed with weft yarns, incorporating therein pile yarns secured periodically below the path of insertion of the weft yarns, in such a manner as to form loops, the tops of which lie against weft yarns on the reverse side of the ground weave, and periodically above said path of insertion of the weft yarns, so that the branches of said pile yarn loops pass through the thickness of the ground weave, between the warp and the weft yarns, and extend, on the front side of the weave, over a certain length, to produce the effect of velvet, whilst the pile yarn loops are secured by gauze-weave warp yarns; said method is characterised in that, during the weaving operation described, extra warp yarns called "leno yarns" are employed as gauze warp yarns, the successive positions of which are so determined that they rise in relation to the ground weave warp yarns, each alternately on one side and then on the other of one of said warp yarns, so that they find themselves above the weft yarns at the moment these latter are inserted, and they form a *first* loop, the top of which lies on the same weft yarn of the ground weave as the top of a pile yarn loop, but on the front of the weave, and also a second loop, the top of which lies on an adjacent weft yarn, also on the front side of the ground weave, whilst the intermediate part of the leno yarn which links the first to the second loop passes snakelike under the warp yarn in question, on the reverse side of the ground weave. It is manifest that this general method lends itself to various methods of execution corresponding to the various kinds of pile fabric manufactured. It is applicable not only to pile fabric woven directly as single-cloth, but also to that produced by the double-cloth method, with subsequent separation of the two cloths by cutting the parts of the pile yarns which link them together.

Finally, the fabric of this invention is made with a loom for weaving the warp pile in double-cloth in order to carry out this method. This loom, which is of the type comprising, for each cloth, a harness with heddle frames for the warp yarns of the ground weave and for the pile yarns, is characterised in that the harness also comprises, for each of the two cloths, at least one frame with fixed heddles, and a system of mobile heddle frames with independent movement, for the formation of a leno by means of an extra leno yarn for the purpose of knotting the pile yarns in the ground weave formed by said warp yarns and weft yarns.

BRIEF DESCRIPTION OF THE DRAWINGS

FIG. 1 is a longitudinal section, showing a first method of producing pile fabric according to the invention, with pile yarn loops in V-formation;

FIG. 2 is a bottom plan view of the pile of FIG. 1;

FIGS. 3 and 4 show, in longitudinal section and in bottom plan view thereof respectively, a second method of producing pile with double-cloth pile and pile yarn loops in V-formation;

DESCRIPTION OF THE PREFERRED EMBODIMENTS

Figure 5:
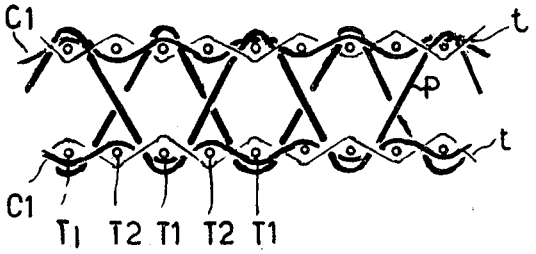
FIGS. 5 and 6 show, in longitudinal section and in bottom plan view thereof respectively, a third method, with double-cloth pile with pile yarn loops in V-formation on both sides of the same warp yarn of the ground weave.

The portion of warp pile according to the invention, shown in longitudinal section in FIG. 1 and from beneath in FIG. 2, comprises a ground weave F composed of warp yarns, e.g. C1, C2 and weft yarns, e.g. T1, T2, loops of pile yarn P, and a leno yarn t.

The top of each pile yarn loop P lies against the lower side of a weft yarn T1, that is to say it appears on the reverse side of the finished weave. Along one particular warp yarn C1, loops of pile yarn P are formed only on the weft yarns T1 which are of odd number. The branches of the pile yarn loops P pass through the thickness of the ground weave F, between the warp and weft yarns, and extend, on the front side of the ground weave F, over a certain length 1, to produce the pile effect. The leno yarn t forms a first loop, the top of which lies on the same weft yarn T1 of the ground weave as the top of the pile yarn loop P but on the front, not on the reverse side of the ground weave F, and a second loop, the top of which lies on an adjacent weft yarn, in this case on a weft yarn T2 of even number, also on the front side of the ground weave. The first loop of the leno yarn t lies against the pile yarn, that is to say on one side of the warp yarn C1, whilst its second loop lies on the other side of this warp yarn, so that, in the example in question, in order that this second leno yarn loop cannot return to the first side of the warp yarn C1 under the tension of the leno yarn (which would completely destroy the knotting effect desired), the second leno yarn loop passes beyond the following warp yarn C2 situated on said other side of the first warp yarn C1. Thus, against a weft yarn T2 of even number, a second leno yarn loop passes to the front, whilst the following warp yarn C2, mentioned above, passes to the reverse side and locks said second leno yarn loop at the side of the first warp yarn C1 opposite to the side of this warp yarn, along which lies the first leno yarn loop which pinches the pile yarn against the warp yarn C1. The first and second leno yarn loops are linked together by an intermediate part of this yarn which passes under the warp concerned (and also under the adjacent yarn C2 in the present example) at the reverse side of the ground weave F.

It will be readily understood that, due to the presence of the leno yarn t incorporated into the weave in the manner described and illustrated, each loop of pile yarn P is firmly knotted on a weft yarn against a warp yarn, so that it has become completely integral with the ground weave F, even though the construction of this latter is not of a kind to provide a strong fabric by itself.

The above description with reference to FIGS. 1 and 2 corresponds to a pile produced as single cloth, employing rods 11 for the formation of the upper, visible loops of pile yarn P. If these rods do not have a cutting edge, they leave the pile yarn loops closed, as shown in the right-hand part of FIG. 1, and the product is called uncut pile, whereas, if they carry an upper cutting edge, they snip the tops of the upper pile yarn loops, as shown at the left-hand side of the figure. Nevertheless, this does not effect the securing of the pile yarn loops to the ground weave by the leno yarn.

The same structure might quite easily be adopted in a double-cloth type of pile construction, as shown in FIGS. 3 and 4, FIG. 3 being a longitudinal section through the combination of the two cloths before their separation by cutting the pile yarn portions P which connect them, and FIG. 4 being a corresponding plan view, i.e. showing the lower cloth from the bottom after cutting. In these figures, the same reference numerals are employed as in FIGS. 1 and 2, so that the same explanation can be applied to the lower cloth 21 as was given for the single cloth of FIGS. 1 and 2, the only difference being that, instead of passing over rods, the upper pile yarn loops P pass over weft yarns of the ground weave of the upper cloth 22. The same description can be applied to the upper cloth, provided top and bottom are reversed in the explanations given with reference to FIGS. 1 and 2.

Figure 6:
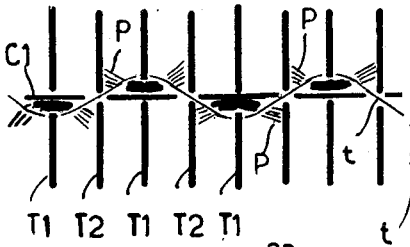

In the embodiments just described in FIGS. 1 to 4, it can be said that the pile yarn loops P present a V-shaped configuration. In FIGS. 5 and 6 a further method of execution is illustrated, having pile yarns in a V-shape, which is applicable more especially to heavy yarns. This embodiment differs from those described above in that the pile yarn loops P, on two successive weft yarns T1 of odd number, are situated alternately on one side and on the other of the same warp yarn C1; in this case, the leno yarn t snakes over the reverse side of the ground weave, embracing only the single warp yarn C1, instead of the two warp yarns C1 and C2 in the foregoing examples.

Figure 8:
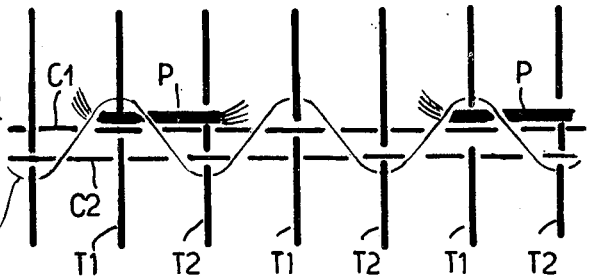
FIGS. 7 and 8 show, in longitudinal section and in bottom plan view thereof respectively, a fourth method of producing double-cloth pile with pile yarn loops in U-formation.
Figure 7:
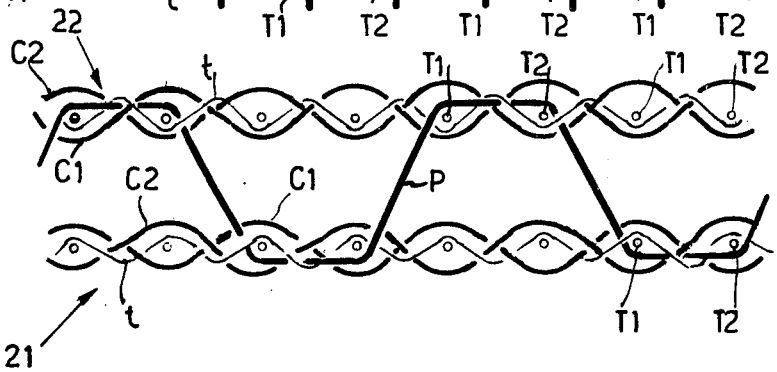

FIGS. 7 and 8 show a method of execution in which the pile yarns P show a U-shaped configuration, due to the fact that each pile yarn loop P embraces, not one single weft yarn of the ground weave, but two successive weft yarns T1 and T2 at one and the same time, as illustrated. In this example the leno yarn t behaves nevertheless in the same manner as in FIGS. 3 and 4, with the difference that, on the front side, only one loop out of two of this yarn serves to pinch a pile yarn loop. It may be said that this structure is obtained by the repetition of a (design) repeat 4.

Figure 9:
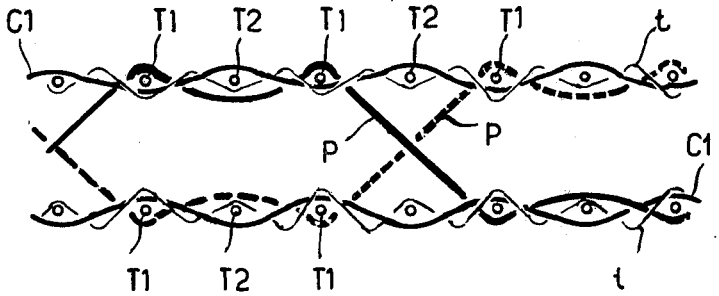
FIGS. 9 and 10 show, in longitudinal section and in bottom plan view thereof respectively, a fifth method of execution of the double-cloth pile with pile yarn loops in W-formation.
Figure 10:
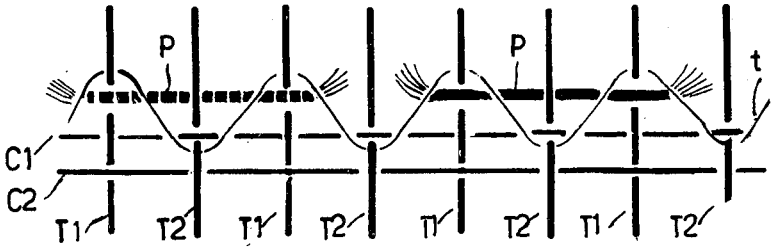

FIGS. 9 and 10 show an example in which the pile yarn loops P show a W-type configuration, due to the fact that each pile yarn loop P passes not only under two weft yarns T1 of odd number, but also over the top of the intermediate weft yarn T2 of even number. Here also, the leno yarn t embraces only the single warp yarn C1, against which rest the pile yarn loops, whilst two of the first successive loops (mentioned above) of said leno yarn serve to pinch one and the same pile yarn loop.

Figure 11:
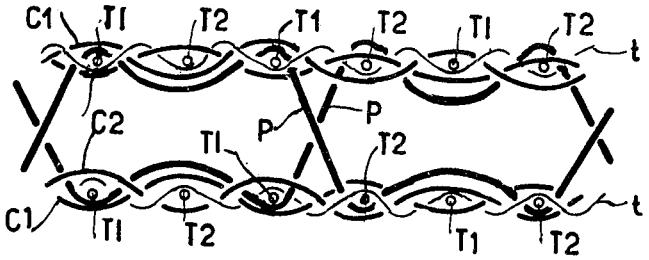
FIGS. 11 and 12 show, in longitudinal section and in bottom plan view thereof respectively, a sixth method of producing double-cloth pile, with pile yarn loops in W-formation, successively on one and on the other side of a pair of warp yarns of the ground weave.
Figure 12:
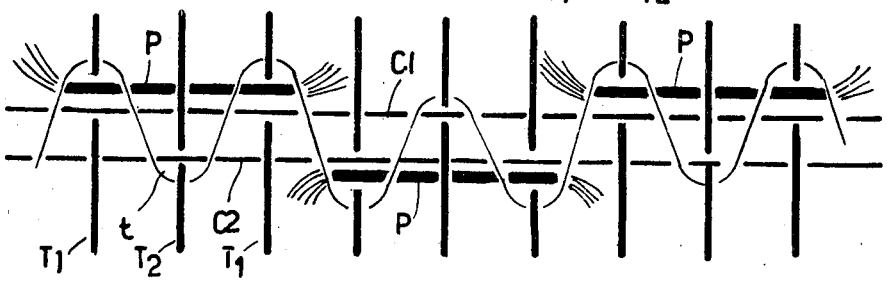

FIGS. 11 and 12 show a modification of the embodiment of FIGS. 9 and 10, from which it differs in that the successive pile yarn loops P are situated alternately on one side and on the other of the warp yarn C1 in question, and that a second warp yarn C2 is also embraced by the leno yarn t and plays symmetrically the same role as the warp yarn C1.

Figure 13:
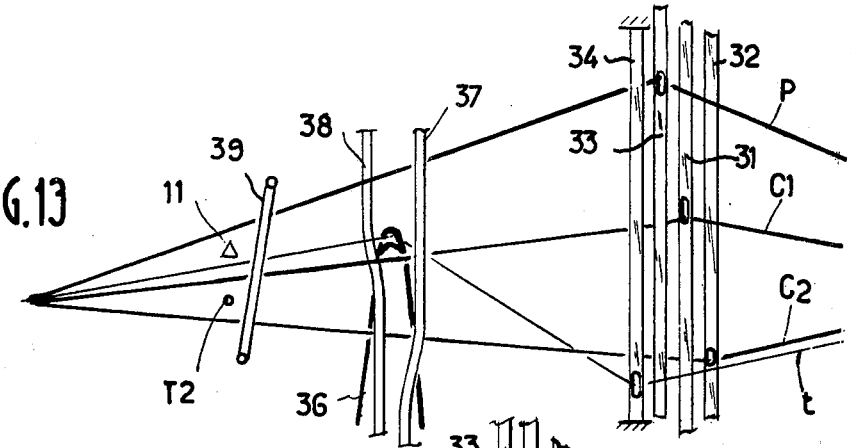
FIGS. 13 and 14 show the main part of a loom for the manufacture of a single-cloth pile according to the invention, diagrammatically in profile and in two different positions.

In order to carry out the method of manufacture of pile according to the invention, a single-cloth loom may be employed, the main part of which is shown diagrammatically in FIG. 13. Here, once again, the yarns mentioned above can be seen, i.e. the two warp yarns C1, C2, the weft yarn T2, the pile yarn P, and the leno yarn t. The two warp yarns C1, C2 are threaded through the eyelets of two heddles 31, 32 respectively, mounted in corresponding mobile harness frames and the pile yarn P is passed through the eyelet of a third heddle 33 mounted in a corresponding mobile frame. As for the leno yarn t, it passes through the eyelet of a fourth heddle 34 mounted in a fixed frame, and also through the eyelet of a fork 36 mounted in a mobile half-frame and co-operating with two heddles 37, 38 mounted respectively in two other frames to form a leno. At 11 will be seen once again the position of the forming and cutting knife for the upper pile yarn loops P.

In the area of the reed 39, three levels of sets of yarns can be seen for the four yarns which have just been enumerated, i.e. the lower level in which is located at the moment the warp yarn C2, the intermediate level in which are located at the moment both the warp yarn C1 and the leno yarn t, and the upper level in which is located at the moment the pile yarn P. These four yarns pass between the two heddles 37, 38 for leno formation and through the same interval between two teeth of the reed 39. It will be observed that the path of the weft yarn T2 to be inserted lies between the lower level and the intermediate level, whereas the rod 11 for forming and cutting the pile yarn is located between the intermediate level and the upper level. As for the eyelet of the fixed frame carrying the leno yarn heddle 34, it remains permanently at the lower level.

Figure 14:
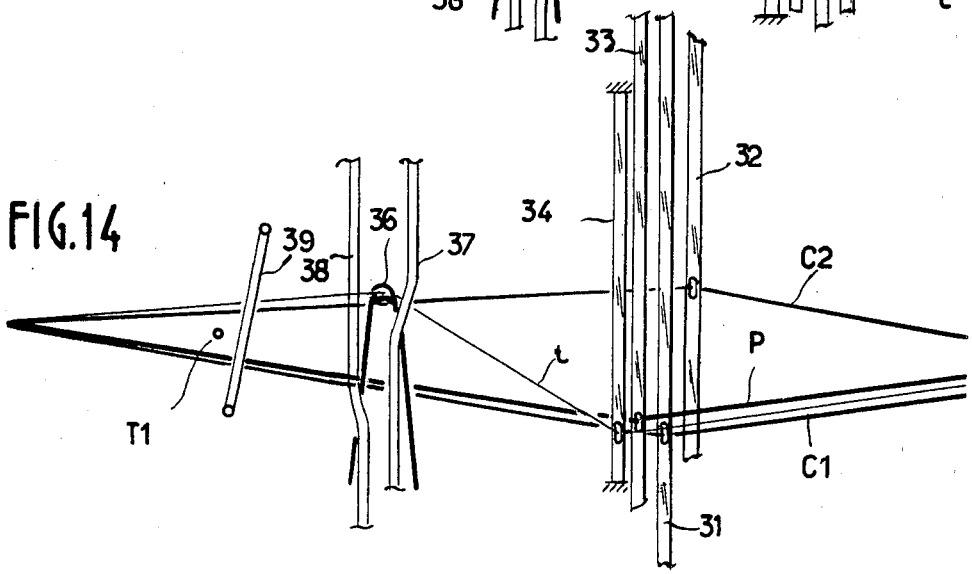

After forming of the following shed, the different elements are situated in the positions shown in FIG. 14, i.e. the pile yarn P is in the lower level (no rod is introduced but instead the pick of the following weft yarn T1), the positions of the two warp yarns C1 and C2 have been interchanged and the leno yarn, after being lowered by the fork 36, has been raised once more to the same intermediate level, but it has passed into its position of crossing with the warp yarn C1, on the other side of the warp yarn C1 in respect of the pile yarn loop, to form a leno, as explained with reference to FIG. 2.

The production of the different possible structures of pile by carrying out the method in question on looms equipped with at least one extra feed frame and two extra mobile frames with a fork-type half-frame, is made possible by suitable programming, previously recorded in the cards of the dobby which controls the movements of the harness frames in which the corresponding heddles are mounted. Programming of this kind is within the ability of a man skilled in the art; it does not form part of the present invention and will not be described in detail here.

It is evident that, for the formation of the leno, instead of the system with two special heddles 37, 38 and fork 39, any other suitable and conventional system may be employed, for example needle heddles, or those of the Madras type.

Figure 15:
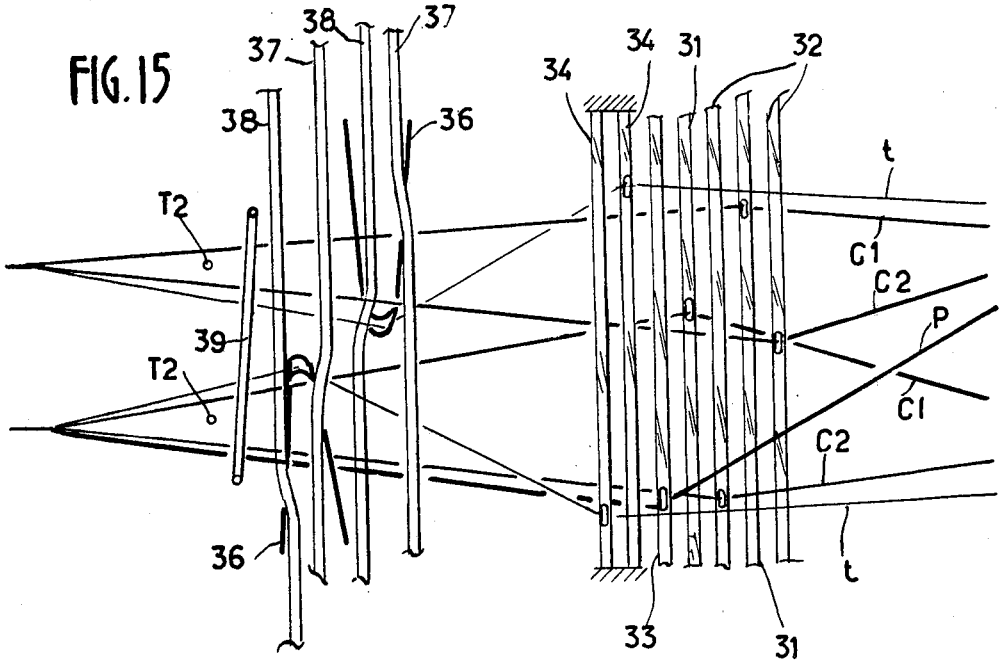
FIGS. 15 and 16 show the main part of a loom for the manufacture of a double-cloth pile according to the invention, diagrammatically in profile and in two different positions.
Figure 16:
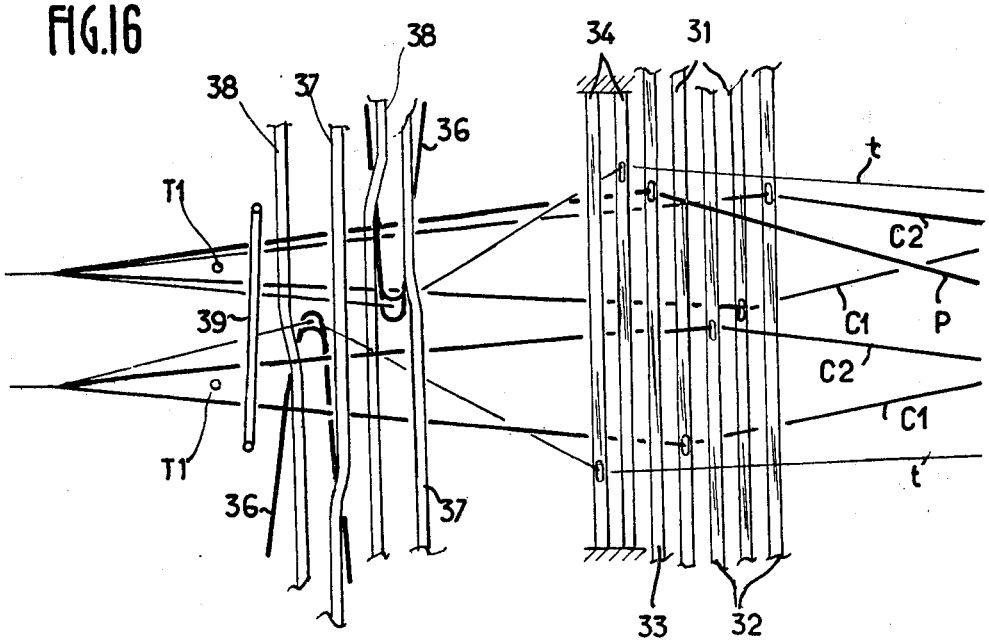

In FIGS. 15 and 16 the main part of a loom for double-cloth weaving of ground weave is shown diagrammatically and, for the lower ground weave cloth, the same reference numerals have been retained as for the single cloth of the loom in FIGS. 13 and 14, since the same elements are to be found here. As for the upper ground weave cloth, all the same elements relating to the lower cloth will be found here once more, but upside down (with vertical directions of displacement reversed), except for the pile yarn which, in this example, is present only once for the two cloths, as is the case in the method of manufacture shown in FIGS. 3 and 4. In other words, the explanations given for the single cloth loom of FIGS. 13 and 14 apply to the double-cloth loom of FIGS. 15 and 16.

It should be noted that, in the double-cloth looms (see FIGS. 15 and 16) the mobile heddle frames for the formation of the leno have an independent movement, i.e. they do not all move together. By this means, on the same loom, it is possible to modify the interval between the two cloths and, consequently, the height of the pile, which would be practically impossible with leno heddles moving simultaneously together.

What is claimed is:

1. Warp pile fabric comprising a ground weave of warp yarns crosed with weft yarns on which are situated, on the reverse side of the fabric, the tops of pile yarn loops secured by warp yarns of gauze-weave type, the branches of said loops passing through the thickness of the ground weave, between the warp and weft yarns and extending, at the front side of the weave, over a certain length to produce the effect of pile, wherein the parts of each pile yarn loop adjacent the tops of said loops are firmly pinched against one side of a warp yarn of the ground weave by one of the said warp yarns of gauze-weave type which is provided by an extra yarn referred to as "leno yarn" forming a first loop, the top of which lies on the same weft yarn of the ground weave as the top of the pile yarn loop and against this pile yarn, but on the front side of the ground weave, and a second loop, the top of which lies on an adjacent weft yarn, on the other side of said warp yarn and also on the front side of the ground weave, the two aforesaid loops of leno yarn which passes under said warp yarn, on the reverse side of the ground weave.

2. Fabric as set forth in claim 1, wherein the warp yarn of the ground weave, against which the aforesaid parts of the pile yarn loops are pinched, passes beneath the weft yarns under which pass the tops of the pile yarn loops, and the part of the leno yarn which links the two loops of this yarn passes under two successive warp yarns of the ground weave.

3. Fabric as set forth in claim 1, wherein the warp yarn of the ground weave, against which the aforesaid parts of the pile yarn loops are pinched, passes above the weft yarns under which the tops of the pile yarn loops pass, and the part of leno yarn which links the two loops of this yarn passes beneath the single warp yarn of the ground weave, against which the pile yarn is pinched.

4. Fabric as set forth in claim 1, or claim 2, or claim 3, wherein along one and the same warp yarn, pile yarn loops are formed only on the weft yarns of odd number of the ground weave, whereas the aforesaid second loops of the leno yarn are formed on the weft yarns of even number of the ground weave.

5. Fabric as set forth in claim 1, or claim 2, or claim 3, wherein the pile yarn forms W-type loops, each of which passes under two successive weft yarns of odd number and on to one intermediate weft yarn of even number of the ground weave.

6. Fabric as set forth in claim 1, or claim 2, or claim 3 wherein two successive pile yarn loops are separated from each other, in the direction of the warp of the ground weave, by an interval which comprises one or more weft yarns of the ground weave.

7. Fabric as set forth in claim 1, 2, or claim 3 wherein all the pile yarn loops pinched against a warp yarn of the ground weave are located on the same side of this warp yarn.

8. Fabric as set forth in claim 1, or claim 2, or claim 3 wherein the successive pile yarn loops pinched against a warp yarn of the ground weave are located alternately on one side and on the other of this warp yarn.

9. Fabric as set forth in claim 8, wherein the successive pile yarn loops pass beneath the weft yarns of odd number of the ground weave, and the aforesaid intermediate parts of the leno yarn pass beneath the weft yarns of even number.

10. A method of manufacture of a warp pile fabric of the type whereby a ground weave is formed from warp yarns crossed with weft yarns, incorporating therein pile yarns inserted periodically below the path of insertion of the weft yarns, in such a manner as to form loops, the tops of which lie against weft yarns on the reverse side of the ground weave, and periodically above said path of insertion of the weft yarns, so that the branches of said pile yarn loops pass through the thickness of the ground weave, between the warp and weft yarns, and extend, on the front side of the weave, over a certain length, to produce the effect of pile, the pile yarn loops being secured by leno warp yarns, comprising, employing during the weaving operation, extra warp yarns, called "leno yarns", positioning said leno yarns in successive positions so that they rise periodically in relation to the ground weave warp yarns, each alternately on one side and then on the other of one of said warp yarns and are themselves above the weft yarns at the moment these latter are inserted, inserting the weft yarns, forming a first loop in each leno yarn the top of which lies on the same weft yarn of the ground weave as the top of a pile yarn loop, but on the front of the ground weave, and forming a second loop in each leno yarn the top of which lies on an adjacent weft yarn on the front side of the ground weave while passing the intermediate part of the leno yarn, which links said first to said second loop, snakelike under the respective warp yarn on the reverse side of the ground weave.

* * * * *